US007647850B2

(12) United States Patent
Kraepel

(10) Patent No.: US 7,647,850 B2
(45) Date of Patent: Jan. 19, 2010

(54) STARTER MOTOR CASING

(75) Inventor: Richard Kraepel, Dearborn, MI (US)

(73) Assignee: DENSO International America, Inc., Southfield, MI (US)

( * ) Notice: Subject to any disclaimer, the term of this patent is extended or adjusted under 35 U.S.C. 154(b) by 0 days.

(21) Appl. No.: 11/672,530

(22) Filed: Feb. 8, 2007

(65) Prior Publication Data

US 2008/0190222 A1 Aug. 14, 2008

(51) Int. Cl.
*F02N 11/00* (2006.01)

(52) U.S. Cl. ..... 74/7 R; 74/7 C

(58) Field of Classification Search ..... 74/6, 74/7 R, 7 B, 7 C; 123/179.15, 195 C
See application file for complete search history.

(56) References Cited

U.S. PATENT DOCUMENTS 4,362,065 A 12/1982 Baratti
5,052,234 A * 10/1991 Sugiyama ..... 74/6
5,163,335 A 11/1992 Isom et al.
RE35,425 E 1/1997 Isom et al.
5,743,140 A 4/1998 Gustafson
5,796,172 A 8/1998 Morisita et al.
5,844,336 A * 12/1998 Ohya et al. ..... 310/80
5,847,471 A 12/1998 Morishita et al.
5,943,909 A * 8/1999 Soh ..... 74/6
6,817,258 B2 11/2004 Kajino et al.

FOREIGN PATENT DOCUMENTS

JP 2002-174161 6/2002
JP 3838868 8/2006
KR 2002-0008589 A * 1/2002

* cited by examiner

*Primary Examiner*—Noah Kamen
(74) *Attorney, Agent, or Firm*—Harness, Dickey & Pierce, PLC

(57) ABSTRACT

A starter assembly has a starter motor with a center casing. A front housing is attached to the center casing and the front housing is adapted to attach the starter assembly to the vehicle. The center casing includes a pilot ring which mates with a groove in the front housing to define a serpentine path between the inside and outside of the starter assembly. The pilot ring is formed at the inside diameter of the center housing to define a dam which prohibits contaminants from entering the center housing.

11 Claims, 6 Drawing Sheets

STARTER MOTOR CASING

CROSS-REFERENCE TO RELATED APPLICATIONS

Field

The present disclosure relates to starter assemblies for internal combustion engines. More particularly, the present disclosure relates to starter assemblies having a universal mount having a step shaped pilot surface.

Background

The statements in this section merely provide background information related to the present disclosure and may not constitute prior art.

Starter assemblies for internal combustion engines are typically designed to fit a specific engine application. This creates a large number of unique starter assemblies which have the identical motor structure but which are different in the way they are adapted for connection to the specific engine.

Adapting a starter assembly for use with multiple engines or use with an engine other than that for which the starter assembly was originally designed is currently known in the art. Typically, such adaptations are made on automobiles for the aftermarket, for the purposes of racing or for the purposes of replacement of expensive or difficult to locate starters on exotic or antique automobiles. Some known starter assembly adaptation techniques require precision, custom machining work and are thus labor intensive and costly.

Other known designs allow for the changing of the attachment rotational angle by providing an adaptive ring with a plurality of attachment holes by which the adaptive ring can be secured to the starter assembly with attachment bolts. The adaptive ring includes a plurality of discrete sets of position holes which can be used to attach an adapter having a plurality of securing holes using attachment bolts. The adapter further includes mounting holes for securing the adapter to the engine using mounting bolts. This system allows the starter assembly to be attached to the engine in a variety of rotational positions.

The mounting of the various housings, adaptive plates and adaptors usually involves a pilot flange which engages a pilot diameter in the mating component to properly align the two components. The point of attachment of the various components with or without a pilot flange is a potential route of water or contaminants entry which can be detrimental to the internal mechanical and electrical components unless proper handling of the ingested water or contaminants is designed into the components.

SUMMARY

The present disclosure provides a universal mount for a starter assembly which does not involve the use of adaptive plates or adaptors. The starter assembly includes a center housing and a front housing. The center housing defines a plurality of sets of mounting holes for the front housing. By selecting different sets of mounting holes for the front housing, the rotational position of the starter assembly with its solenoid can be adjusted.

The center housing and front housing also define a piloting system which is configured to guide any water or contaminants that may leak past the attachment interface to a position away from the internal mechanical and electrical components of the starter assembly. In addition, the piloting system provides additional support for the starter assembly which lessens the tendency of a gap being formed at the attachment interface.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
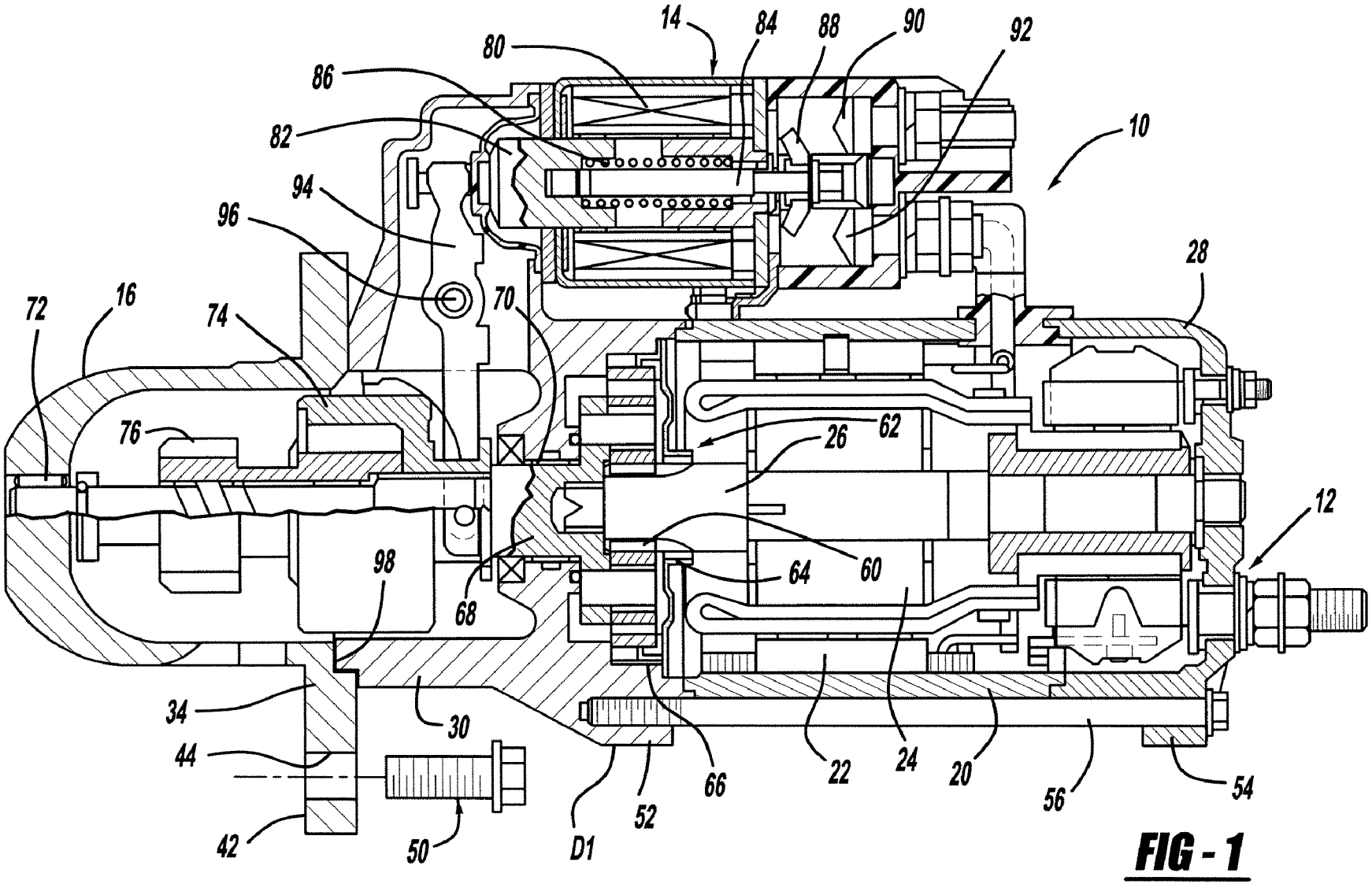
FIG. 1 is a side cross-sectional view of a starter assembly incorporating the mounting system in accordance with the present disclosure.

The following description is merely exemplary in nature and is not intended to limit the present disclosure, application, or uses. There is illustrated in FIG. 1 a starter assembly 10 for an internal combustion engine. Starter assembly 10 comprises a starter motor 12, an electromagnetic plunger 14 and a front housing 16.

Starter motor 12 comprises a motor housing 20, a stator 22, a rotor 24 and a motor shaft 26. Motor shaft 26 is press-fit to rotor 24 as is known in the art. An end frame 28 is fixed to the rear portion of motor housing 20 and a center casing 30 is fixed to the front portion thereof.

Figure 3:
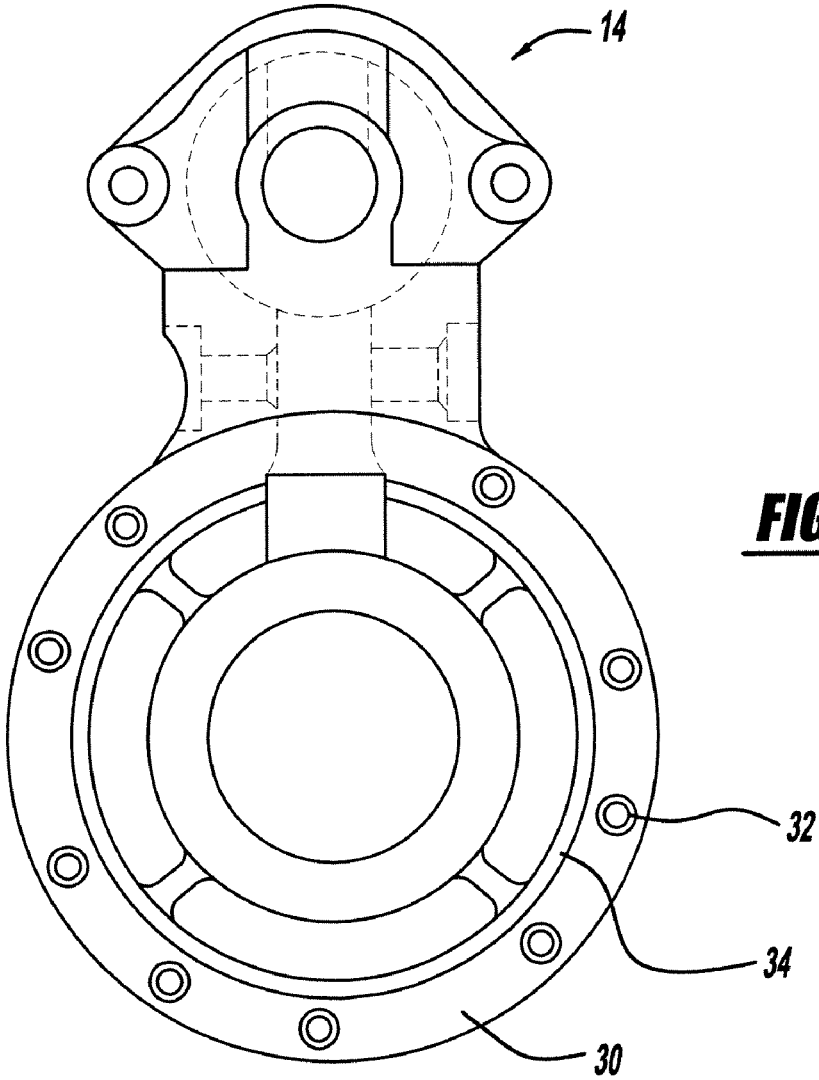
FIG. 3 is an end view of the center housing of the starter motor with the front housing removed.

As illustrated in FIG. 3, a plurality of threaded bores 32 are formed at the front surface of center casing 30. Front housing 16 includes a flange 34 at the open end thereof for attachment of front housing 16 to center casing 30 of starter motor 12.

Figure 4:
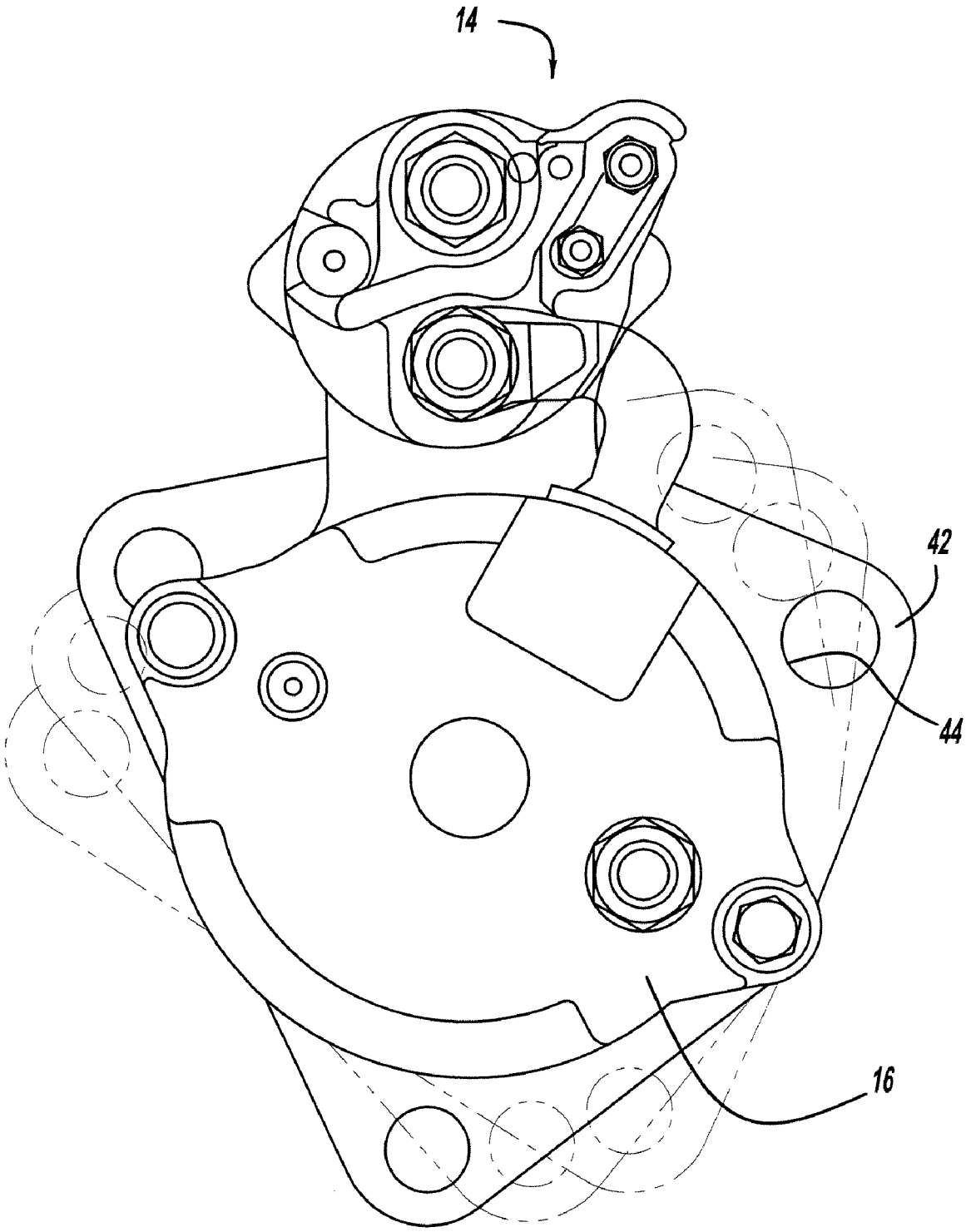
FIG. 4 is an end view of the center casing and end housing illustrated in FIG. 1 showing the various rotational positions of the front housing.

Flange 34 of front housing 16 defines a plurality of through holes 40 which are in a pattern designed to mate with a specific set of threaded bores 32. Threaded bores 32 are designed to define a plurality of sets of patterns that align with the pattern of through holes 40 in flange 34 of front housing 16. In this manner, front housing 16 can be mounted in a plurality of rotational positions with respect to starter motor 12 as illustrated in FIG. 4. Flange 34 of front housing 16 also defines a plurality of ear-like fixing portions 42 projecting radially outward from the outer periphery thereof. Each ear-like fixing portion defines a fastening hole 44. Front housing 16 is fixed to the front surface of center casing 30 at flange 34 using a plurality of bolts which extend through the through holes to threadingly engage a respective threaded bore 32. As illustrated in FIG. 4, front housing 16 can be fixed to center casing 30 at a rotational or angular position with respect to center casing 30 such that starter assembly 10 will fit into a specific vehicle application.

Figure 5:
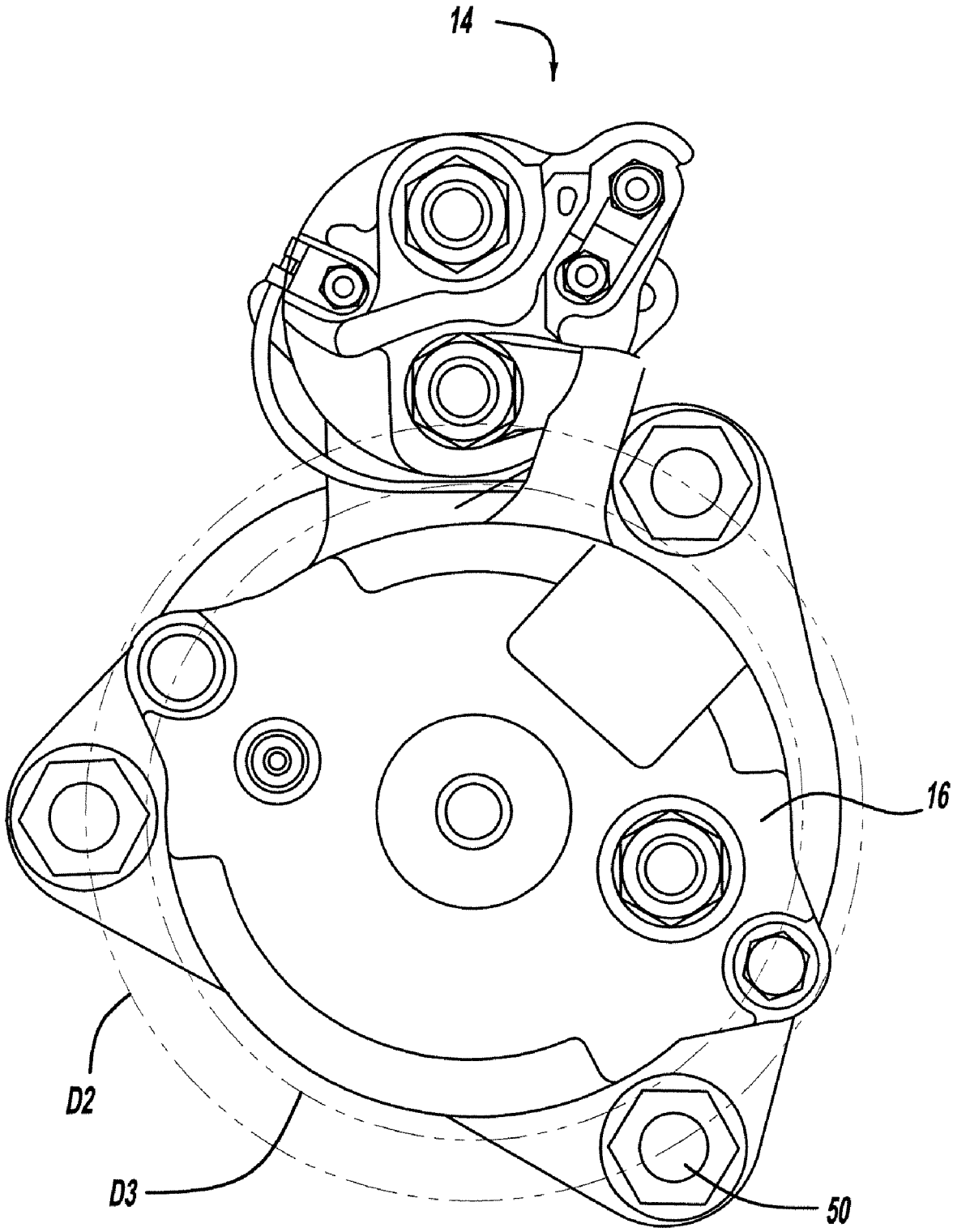
FIG. 5 is an end view of the starter assembly illustrated in FIG. 1.

Motor housing 20, end frame 28 and center casing 30 have nearly the same outside diameter D1 as illustrated in FIG. 1. Starter assembly 10 is fixed to a bracket (not shown) of an internal combustion engine (not shown) using a plurality of fastening bolts 50 which extend through fastening holes 44. Fastening holes 44 are formed on a circumference of a diameter D2 to prevent motor housing 20 from obstructing access to the heads of the plurality of fastening bolts 50 as illustrated in FIG. 5. In other words, diameter D1 is made smaller than the diameter D3 of an inscribed circle of the heads of the plurality of fastening bolts 50. Accordingly, a fixing tool, such as a socket wrench can have access to the heads of the plurality of fastening bolts 50 around motor housing 20.

End frame 28 and center casing 30 each have two pairs of radially projecting fixing portions 52 and 54 and they are attached to each other by two fastening bolts 56 using fixing portions 52 and 54.

Motor shaft 26 extends through the inside of center casing 30 and it carries a sun gear 60 of a planetary gear speed reduction mechanism 62 that is comprised of planetary gears 64 and a ring gear 66. Planetary gears 64 are fixed to the rear portion of a drive shaft 68 and ring gear 66 is fixed to the inner wall of center casing 30.

Drive shaft 68 is supported at its rear end by center casing 30 using a rear bearing 70 and at its front end by front housing 16 using a front bearing 72 such that drive shaft 68 is coaxial with motor shaft 26. An overrunning clutch 74 and a pinion 76 are carried by drive shaft 68 such that they slide axially along drive shaft 68.

Electromagnetic plunger 14 is disposed on motor housing 20 and center casing 30. Electromagnetic plunger 14 comprises an electromagnetic coil 80, a plunger 82, a rod 84, a compression coil spring 86, a contact bridge 88, and a pair of stationary contacts 90 and 92. Compression coil spring 86 and rod 84 are disposed inside electromagnetic coil 80. Contact bridge 88 is fixed to the end of plunger 82 that projects from electromagnetic coil 80 to face the pair of stationary contacts 90 and 92.

A lever 94 is rotatably supported by a pin 96. Lever 94 is fixed at its upper end to a front portion of plunger 82. A ring-shaped dust seal 98 is disposed between flange 34 and center casing 30 such that an inner edge of dust seal 98 contacts the outer periphery of overrunning clutch 74 thereby keeping dust off the inside of center casing 30.

When a starter switch is turned on, electromagnetic coil 80 is energized to move plunger 82 together with rod 84 rearward or to the right in FIG. 1. This causes lever 94 to rotate about pin 96. Therefore, pinion 76 together with overrunning clutch 74 are moved along drive shaft 68 forward or to the left in FIG. 1 to engage a ring gear (not shown) of the engine. When plunger 82 moves to the right as shown in FIG. 1, rod 84 urges contact bridge against stationary contacts 90 and 92 and this closes the power circuit to starter motor 12. Accordingly, motor shaft 26 rotates drive shaft 68 via sun gear 60 and planetary gears 64 of planetary gear speed reduction mechanism 62. This rotates the ring gear of the engine and the engine will start.

Figure 2:
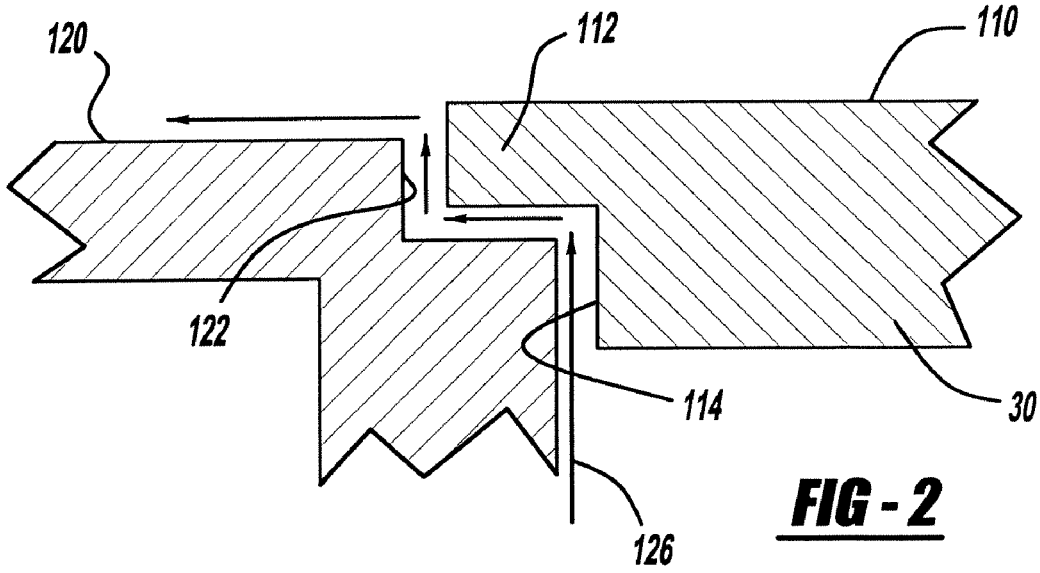
FIG. 2 is an enlarged cross-sectional view of the piloting system of the present disclosure.

Referring now to FIG. 2, the mounting system in accordance with the present disclosure is described in more detail. Center casing 30 defines an inside diameter 110 and an axially extending flange or pilot ring 112 which forms an outer groove 114. Pilot ring 112 includes an extension of inside diameter 110 and it is located on the radially inner portion of the end face of center casing 30. Front housing 16 defines an inside diameter 120 which is larger than inside diameter 110 of center casing 30. Front housing 16 also defines an inner groove 122 which accepts pilot ring 112 of center casing 30. This mounting system creates a serpentine path depicted by arrow 126 through which any water or contaminants must flow from the environment outside the starter assembly in order to reach the inside chamber of front housing 16 and/or center casing 30. Once any water or contaminants reach the inside of front housing 16, the fact that inside diameter 120 is larger than inside diameter 110 creates a dam which will have a tendency to direct the water or the contaminants into front housing 16 and away from the inside chamber of center casing 30 within which the electrical and mechanical components of starter motor 12 are located.

Figure 6A:
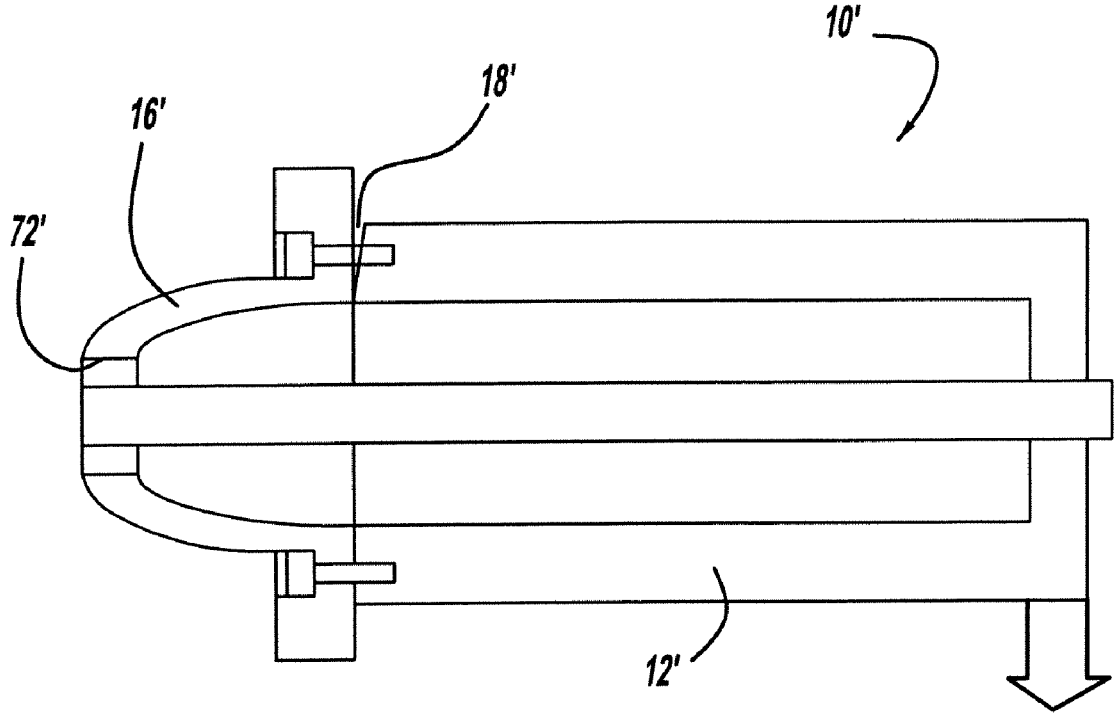
FIG - 6A Prior Art
FIG. 6A is a schematic view of a prior art mounting system.
Figure 6B:
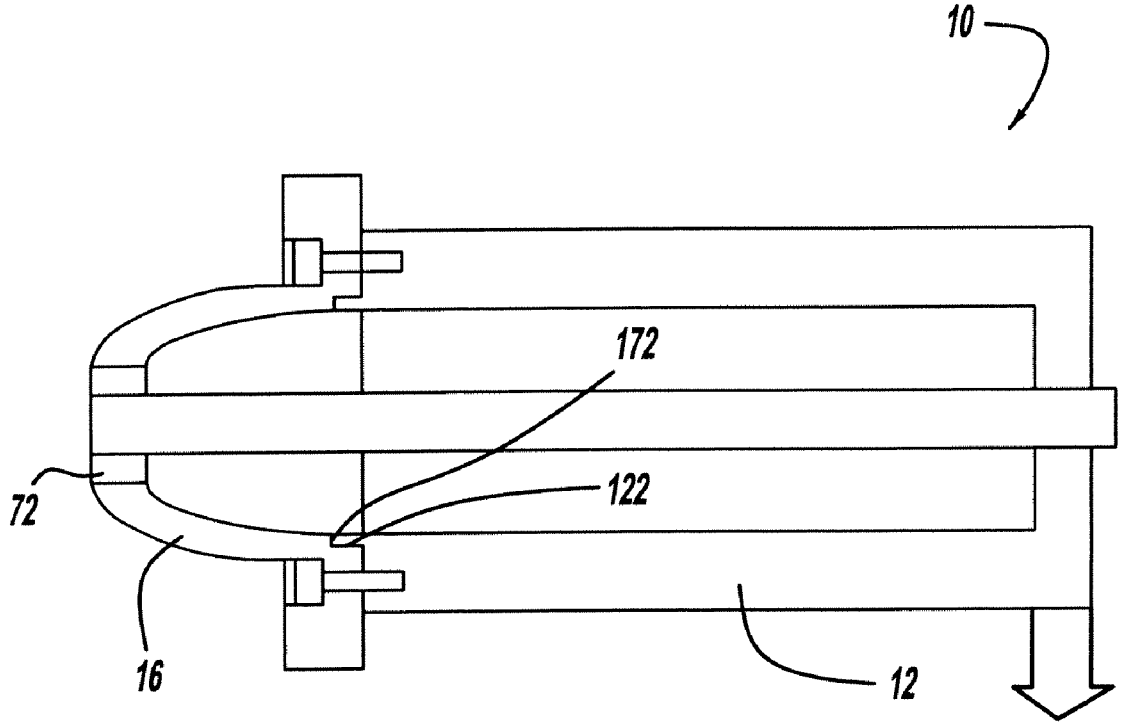
FIG. 6B is a schematic view of the mounting system of the present disclosure.

Referring now to FIGS. 6A and 6B, a prior art mounting system is compared with the mounting system in accordance with the present disclosure. In the prior art mounting system illustrated in FIG. 6A, because a starter assembly 10' is cantilevered from a front housing 16', the weight of and the vibration of a starter motor 12' will easily create an opening 18' at the top of the interface between front housing 16' and starter motor 12' as illustrated in FIG. 6A. In addition, the movement of starter motor 12' in relation to front housing 16' causes additional stress to a front bearing 72' in front housing 16'.

In the mounting system of the present disclosure as illustrated in FIG. 6B, the engagement between pilot ring 112 and inner groove 122 provide support for starter motor 12 and thus a more robust connection between starter motor 12 and front housing 16. This additional support reduces the tendency to create an opening similar to opening 18' of the prior art and it reduces the stress on front bearing 72 of front housing 16.

Figure 7A:
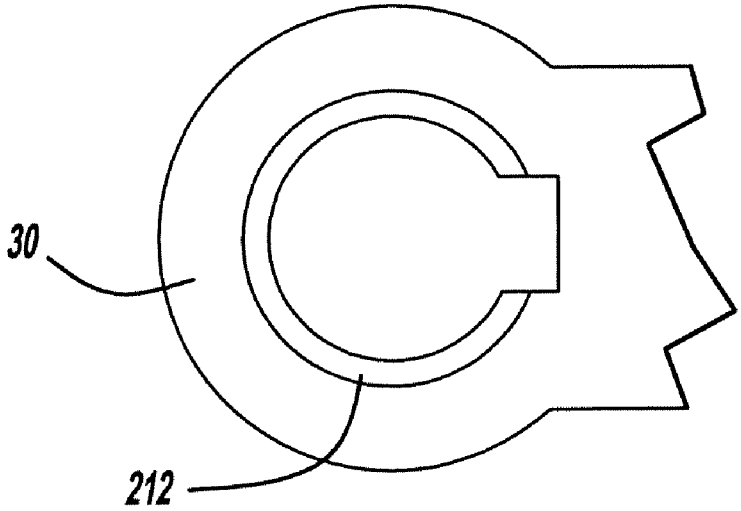
FIG. 7A is a schematic view of the pilot ring illustrated in FIGS. 1-3; and, FIG. 7B is a schematic view of a pilot ring in accordance with the present invention.
Figure 7B:
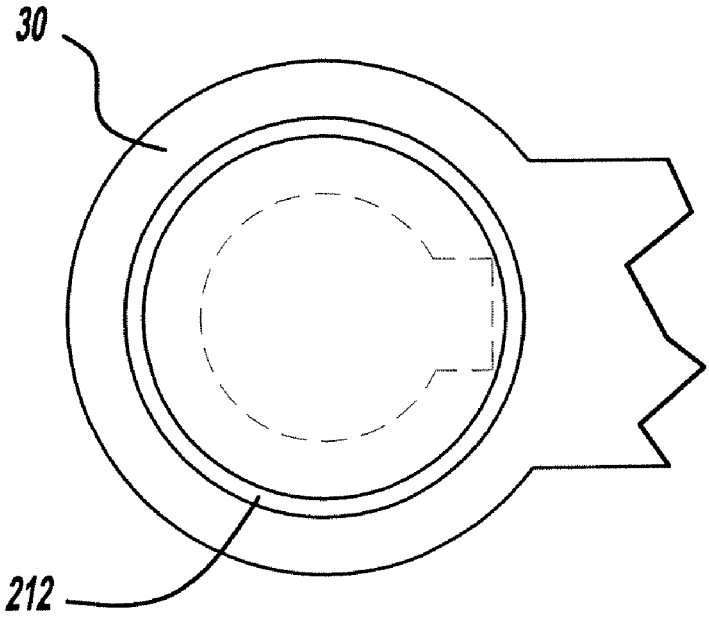

Referring now to FIGS. 7A and 7B, a mounting system in accordance with another embodiment of the present disclosure is illustrated in FIG. 7B. In the embodiment described above, as shown in FIG. 7A, pilot ring 112 is a C-shaped pilot which does not interfere with lever 94 inside center casing 30 as illustrated by a dashed line in FIG. 7B. As disclosed in FIG. 7B, center casing 30 can be increased in diameter and a full circle shape pilot ring 212 can be used in place of pilot ring 112. Front housing 16 will also have to be designed to mate with the increased diameter center casing 30.

What is claimed is:

1. A starter assembly comprising:

a starter motor;

a center casing attached to said starter motor;

a front housing attached to said center casing, said front housing and said center casing defining a serpentine path between said center casing and said front housing, said serpentine path extending from an external end outside of said starter assembly to an internal end inside said starter assembly, said front housing having an inside diameter at said internal end of said serpentine path larger than an inside diameter of said center casing at said internal end of said serpentine path to create a dam immediately adjacent said internal end of said serpentine path such that contaminants flowing into said starter assembly through said serpentine path will be directed into said front housing, said serpentine path being defined by a first surface of said center casing and a second surface of said front housing, said first and second surfaces extending continuously between said external end of said serpentine path and said internal end of said serpentine path.

2. The starter assembly according to claim 1, wherein said center casing defines an annular pilot ring.

3. The starter assembly according to claim 2, wherein said center casing defines a plurality of sets of mounting holes, said front housing defining a set of mounting holes which align individually with each of said plurality of sets of mounting holes.

4. The starter assembly according to claim 1, wherein said center casing defines a C-shaped pilot ring.

5. The starter assembly according to claim 4, wherein said center casing defines a plurality of sets of mounting holes, said front housing defining a set of mounting holes which align individually with each of said plurality of sets of mounting holes.

6. The starter assembly according to claim 1, further comprising a dust seal disposed between the front housing and the center casing.

7. The starter assembly according to claim 6, wherein the dust seal is disposed within the groove of the front housing.

8. The starter assembly according to claim 6, wherein the starter assembly further comprises an overrunning clutch, the dust seal being in contact with the overrunning clutch.

9. A starter assembly comprising:

a starter motor;

a center casing attached to said starter motor, said center casing defining an outer groove;

a front housing attached to said center housing, said front housing defining an inner groove, said inner groove engaging said outer groove to create a serpentine path between said center casing and said front housing, said serpentine path extending between an inlet located on an exterior surface of said center housing and an outlet located on an interior surface of said front housing, an inside diameter of said front housing immediately adjacent said outlet of said serpentine path being greater than an inside diameter of said center housing immediately adjacent said outlet of said serpentine path to create a dam immediately adjacent said outlet of said serpentine path such that contaminants flowing into said starter assembly through said serpentine path will be directed into said front housing, said serpentine path being defined by a first surface of said center casing and a second surface of said front housing, said first and second surfaces extending continuously between said outlet and said inlet of said serpentine path.

10. The starter assembly according to claim 9, wherein neither said inner groove or said outer groove defines a cut-out portion which defines said serpentine path.

11. A starter assembly comprising:

a starter motor;

a central casing attached to said starter motor, a front housing attached to said central casing; wherein a surface of said central casing and a surface of said front housing defining a serpentine path extending between an inlet at an exterior surface of said starter assembly and an outlet at an interior chamber of said front housing and an internal chamber of said central casing, said surface of said central casing and said surface of said front housing extending continuously between said inlet and said outlet; and said surface of said central casing defines a dam immediately adjacent said outlet of said serpentine path which directs contaminants flowing through said serpentine path away from said interior chamber of said central casing and towards said interior chamber of said front housing.

* * * * *